United States Patent [19]

Kodama

[11] 4,176,516

[45] Dec. 4, 1979

[54] ARRANGEMENT FOR PUTTING AN ELECTRONIC TIMEPIECE RIGHT WITH MINUTE INDICATION ADVANCED AT FIRST

[75] Inventor: Yukuo Kodama, Tokyo, Japan

[73] Assignee: Nippon Electric Co., Ltd., Tokyo, Japan

[21] Appl. No.: 878,394

[22] Filed: Feb. 16, 1978

Related U.S. Application Data

[63] Continuation of Ser. No. 694,967, Jun. 11, 1976, abandoned.

[30] Foreign Application Priority Data

Jun. 13, 1975 [JP] Japan ..... 50-71757
Sep. 27, 1975 [JP] Japan ..... 50-1166773

[51] Int. Cl.[2] ..... G04C 3/00
[52] U.S. Cl. ..... 58/23 R; 58/4 A; 58/50 R; 58/85.5
[58] Field of Search ..... 58/4 A, 23 R, 50 R, 58/85.5, 34

[56] References Cited

U.S. PATENT DOCUMENTS 3,810,356 5/1974 Fujita ..... 58/23 R
3,852,950 12/1974 Yoda et al. ..... 58/85.5 X
3,943,696 3/1976 Portmann et al. ..... 58/85.5 X
3,953,964 5/1976 Suppa et al. ..... 58/50 R
3,962,858 6/1976 Levine et al. ..... 58/50 R X

*Primary Examiner*—Ulysses Weldon
*Attorney, Agent, or Firm*—Hopgood, Calimafde, Kalil, Blaustein & Lieberman

[57] ABSTRACT

An arrangement for correcting an electronic timepiece comprises a normally reset flip-flop that holds, when set, a "second" counter in a reset state. When a first switch is closed after being released, the timepiece cyclically gives a normal, a "minute," and an "hour" indication. While a "minute" indication is given, a second switch is closed to set the flip-flop and advance a "minute" counter. When the second switch is released after the "minute" indication is advanced to a correct time, the "second" and "minute" counter are kept still. When the first switch is closed at the correct time after being preliminarily released, the flip-flop is reset to restart the watch with correct "minute" and "second" indications. The arrangement enables the correction to be carried out once again. While given, an "hour" indication is corrected by the second switch. If desired, correction of the "minute" and "second" indications and/or the "hour" indication may be omitted and a "day" or a longer-unit indication may be corrected by the second switch.

12 Claims, 3 Drawing Figures

ARRANGEMENT FOR PUTTING AN ELECTRONIC TIMEPIECE RIGHT WITH MINUTE INDICATION ADVANCED AT FIRST

This is a continuation of Ser. No. 694,967 filed June 11, 1976, now abandoned.

BACKGROUND OF THE INVENTION

This invention relates to an arrangement for correcting an electronic timpiece. The timepiece may be a multi-functional one that gives an indication of time in "days of a week," "days of a month," "month," and even "years," besides in "hours" or "o'clock," "minutes," and "seconds." The timepiece may be a watch, a clock, or the like, and the arrangement of this invention is equally well applicable to any such timepiece.

A conventional multi-functional electronic watch automatically deals with the difference in the number of days in a month and even with the difference between a civil and a usual leap year. It is, however, necessary to manually correct the watch indication upon making the first use thereof, upon renewal of a self-contained battery, upon a change to and from daylight-saving time, due to a difference in standard times, at an intercalary "second," upon a change between the Gregorian calendar and another, and in like cases. A conventional watch for indicating the seven units of time mentioned above comprises seven switches for manually correcting the respective indications of each unit. It has consequently been time consuming and troublesome to correct the indication of an electronic timpiece.

SUMMARY OF THE INVENTION

It is therefore an object of the present invention to provide an arrangement for manually correcting the indication of an electronic timepiece with only two manually operable switches.

It is another object of this invention to provide an arrangement of the type described, with which it is possible to correct an electronic timepiece rapidly and with ease.

An electronic timepiece to which an arrangement according to this invention is applicable comprises a terminal for a d.c. power, a clock generator responsive to the d.c. power for generating clock pulses of a period shorter than about one-tenth of a "second," and a first resettable counter device that may be a "second" counter. During normal operation, the first counter device counts first input pulses from zero to a predetermined integer in each "minute" to produce first output signals. When held in a reset state, the first counter device is put in a state of counting zero. Responsive to the clock pulses, a first pulse supply device supplies the first input pulses to the first counter device. A second counter counts second input pulses to produce second output signals representative of "minutes" of an indication of time. A pulse producing means produces output pulses of a period of about one "second," such as 0.5 "second," in response to the clock pulses. A second pulse supply means, when put in its normal state while the first counter devices is put into operation, supplies the first output signals once in every "minute" to the second counter device as the second input pulses. When put in its normal state, while the first counter device is held in the reset state, the second pulse supply means supplies no second input pulses to the second counter device. When put in its biased state, the second pulse supply means supplies no first output signals, but the output pulses to the second counter device as the second input pulses to make the latter step at a faster rate. A third counter device counts third input pulses to produce third output signals representative of "hours" or "o'clock" of the indication. Third pulse supply means, when put in its normal state, supplies the second output signals once every "hour" and, when put in its biased state, produces no second output signals but the output pulses to the third counter device as the third input pulses. A display unit is operatively coupled to the terminal, either directly or through the clock pulse generator, and at least to the second and third counter devices. A first switch is manually operable into a selected one of a display and a rest position. Display control means is operatively coupled to the first switch and is display unit and cyclically put in a plurality of states when the first switch is repeatedly put into the display position. The states of the display control means comprise a sequence of an indication or normal state, a "minute" state, and an "hour" state. The display control means makes the display unit display the indication when put in the indication state, "minutes" or, as the case may be, "minutes" and "seconds" of the indication when put in the "minute" state, and at least "hours" of the indication when put in the "hour" state. The states may further comprise another indication state to make the display unit give the indication in two different ranges, for example, in "hours, "minutes," and "seconds", and in "years," "months," "days of a month," and "days of a week," or the like.

The arrangement of the invention comprises a second switch manually operable into selected one of an operative and an inoperative position. First control means is operatively coupled to the first and second switches, display control means, and first counter device, and is normally put in a first state for putting the first counter device into operation. While the display control means is kept in the "minute" state, the first control means is switched to a second state when the second switch is put in the operative position and switched back to the first state when the first switch is put into the display position after the second switch is put back into the inoperative position. The first control means, when put in the second state, holds the first counter device in the reset state. Second control means is operatively coupled to the second switch, display control means, and second pulse supply means and puts the second pulse supply means into its biased state when the second switch is put in the operative position while the display control means is kept in the "minute" state. The second control means otherwise leaves the second pulse supply means in operation. Adjusting means is operatively coupled to the first switch, display control means, and first control means and keeps the display control means in the "minute" state even when the first switch is put into the display position from the rest position at least once again after the first control means is switched to the second state for the first time after the display control means is put into the "minute" state.

DESCRIPTION OF THE PREFERRED EMBODIMENTS

Figure 1:
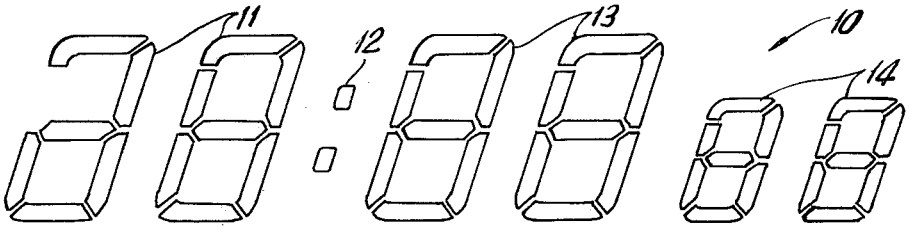
FIG. 1 is a schematic enlarged front view of a display unit of an electronic timepiece to which the present invention is applicable.

Referring to FIG. 1, a display unit 10 of an electronic timepiece comprises a plurality of liquid crystal segments, light emitting diodes, or similar elements, which are divided into a first block 11, a second block 12 of two dots, a third block 13, and a fourth block 14. In the example illustrated in FIG. 1, the first block 11 is for "hours" or "o'clock" of an indication of time and also for "months," in numbers, of the indication. When the first block 11 indicates "hours," the third and fourth blocks 13 and 14 indicate "minutes" and "seconds" with the dots 12 preferably steadily luminescing. Alternatively, the third and fourth blocks 13 and 14 may indicate "minutes" and "days of a month" with the dots 12 intermittently luminescing at a period of about one "second," such as 0.5 "second." Again, the third and fourth blocks 13 and 14 may give an indication of "minutes" and either "A" or "P" for a.m. and p.m. with the dots 12 intermittently luminescing. When the first block 11 indicates "months," the third and fourth blocks 13 and 14 indicate "days of a month" and "years" of the indication with the dots 12 intermittently luminescing. Although not shown, it is known in the art to make the timepiece display "days of a week."

Figure 2:
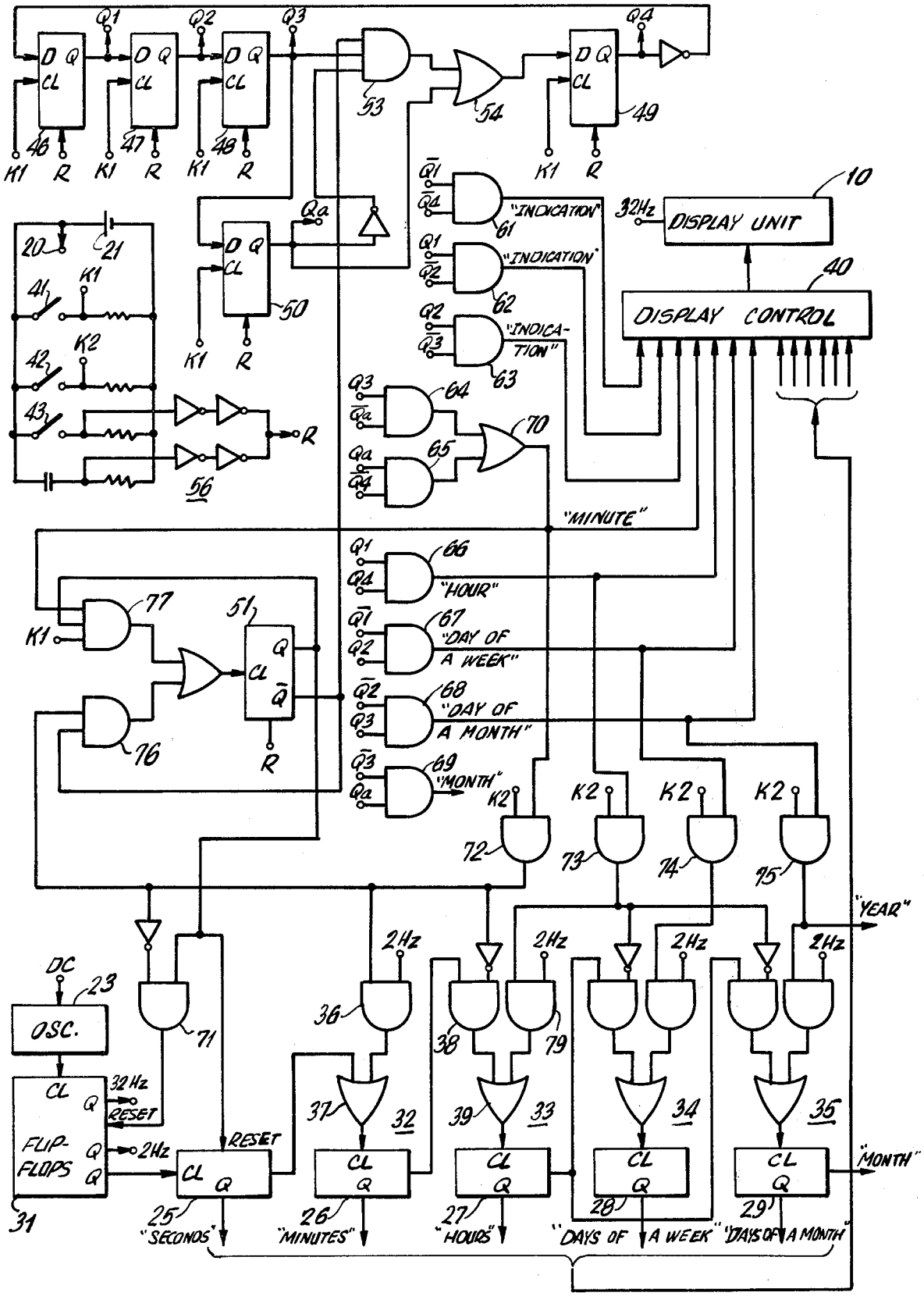
FIG. 2 is a block diagram of an arrangement according to a first embodiment of this invention and of a part of an electronic timepiece comprising the arrangement.

Referring now to FIG. 2, an electronic timepiece comprises a display unit 10 including the blocks 11 and others, such as illustrated in FIG. 1, a terminal 20 for receiving a d.c. power from a self-contained battery 21. A clock generator 23, which is responsive to the d.c. power, generates clock pulses of a period shorter than about one-tenth of a "second," such as at a frequency of 32.768 or 16.384 kHz. A first resettable counter device 25 count, when it is put in operation, first input pulses from zero to a predetermined integer in each "minute" to produce first output signals representative of "seconds" of an indication of time by the display unit 10. When held in a reset state in the manner later described, the first counter device 25 is kept in a state of counting zero. As will shortly be described, second, third, fourth, and fifth counter devices 26, 27, 28, and 29 produce, in response to second, third, fourth, and fifth input pulses, second, third, fourth, and fifth output signals, which are respectively representative of "minutes," "hours," "days of a week," and "days of a month." A group of flip-flops 31 which are responsive to the clock pulses, produce a liquid crystal exciting signal of a period of about one-tenth of a "second," such as at a frequency of 32 Hz, and output pulses of a period of about one "second," such as of at a frequency of 2 Hz. The flip-flop group 31 also supplies the first input pulses to the first counter device 25 and thus serves as a first pulse supply means or device. When put out of operation as described hereunder, the flip-flop group 31 supplies no first input pulses to the first counter device 25.

The timepiece further comprises second, third, fourth, and fifth pulse supply devices 32, 33, 34, and 35, which are respectively coupled to counter devices 26, 27, 28, and 29. The second pulse supply device 32 comprises a normally disabled AND gate 36 and an OR gate 37 connected to the output of gate 36. When put into operation, the first counter device 25 produces a pulse once every "minute," which pulse is supplied to the second counter device 26 as a second input pulse through the OR gate 37. When the first counter device 25 is held in the reset state, the OR gate 37 supplies no first output signals to the second counter device 26. The third pulse supply device 33 comprises a normally enabled AND gate 38 and an OR gate 39 to supply the second output signals once every "hour" to the third counter device 27. The fourth and fifth pulses supply devices 34 and 35 are of a structure similar to the third pulse supply device 33 and respectively supply, when put in its normal state, the third output signals once every "day" to the fourth and fifth counter devices 28 and 29. Although not shown, further counter devices for "months" and "years" of the indication may be included in the timepiece with additional pulse supply and processing devices, similar to the second through fifth pulse supply devices 32 through 35, interposed between the fifth counter device 29 and the further counter devices for supplying the fifth output signals once every "month" according to the days of a "month" and the output signals of the counter device for "months" once every "year" to the counter device for "years" as symbolized at 39'. The first counter device 25 and the other counting devices may be shift registers. In the example illustrated, the counter devices are coupled to the display unit 10 through a display control unit 40. Depending on the elements that give the indication of time, the display unit 10 is supplied with an electric power of a different frequency.

A first switch 41 is manually operable to a selected one of a display or closed position to produce a first switch signal K1 and to a rest or open (released) position. A second switch 42 is also manually operable to an operative or closed position to produce a second switch signal K2 and to an inoperative or open (released) position. A third switch 43, which is manually operable to a sequential or open (released) position and to a resetting or closed position for producing a clearing signal R may also be provided, as shown in FIG. 2. The switches 41 through 43 may be, as shown, connected across the battery 21 through pull down resistors.

The timepiece further comprises first, second, third, and fourth generally cylically connected D-type flip-flops 46, 47, 48, and 49, each having a clock or trigger input terminal CL, a signal input terminal D for a conditioning input sginal, and an output terminal Q for supplying a conditioning output signal Q1, Q2, Q3, or Q4 to the next following D-type flip-flop as the conditioning input signal. The third flip-flop 48 supplies its output signal Q3 also to an adjusting or additional D-type flip-flop 50, which similarly produces a conditioning output signal Qa. A binary flip-flop 51 having an input terminal CL, a first output terminal $\overline{Q}$, and a second output terminal Q is alternatingly put in a first and a second state of producing a first state or logic "1" $\overline{Q}$ output signal and a second state or logic "1" Q output signal from the first and second output terminals $\overline{Q}$ and Q, respectively, every time a clock or trigger input signal is supplied to the input terminal CL in the manner described hereunder. The fourth flip-flop 49 receives its conditioning input signal from the third and additional flip-flops 48 and 50 through an adjusting AND gate 53 and an OR gate 54 as described also hereinbelow. An auto-clear circuit 56 automatically clears the flip-flops 46 through 51 by a clearing signal R when battery 21 is put in place either for the first use of the timepiece or for renewal to put the conditioning output signals Q1, Q2, Q3, Qa, and Q4 in a No. 1 logic state (0, 0, 0, 0, 0) and to put the binary flip-flop 51 in the first state. At this instant, the AND gate 53 is enabled by the cooperation of the first state signal $\overline{Q}$ and a logic "1" AND gate input signal supplied from the additional flip-flop 50 through an inverter. When the first switch 41 is closed, a first switch signal K1 is supplied to the clock input terminals CL of the D-type flip-flops 46 through 50. Inasmuch as the first flip-flop 46 alone is supplied with a logic "1" conditioning input signal through an inverter, the output signals are now put into a No. 2 logic state (1, 0, 0, 0, 0). The output signals are thus cyclically put in logic states listed in Table 1 when the first switch 41 is repeatedly closed after being released. It is, however, to be noted that the conditioning output signals, when put into a No. 4 logic state (1, 1, 1, 0, 0), are put directly into a No. 6 logic state (1, 1, 1, 1, 1) as described below when the first switch 41 is put into the display position from the rest position with the second switch 42 left untouched. This means that a No. 5 logic state (1, 1, 1, 1, 0) is skipped when the first switch 41 alone is manually operated. A plurality of state-defining AND gates 61, 62, 63, 64, 65, 66, 67, 68, and 69 are provided between the D-type flip-flop output terminals Q and the display control unit 40, and an the inputs of an adjusting OR gate 70 are connected to outputs of the AND gates 64 and 65.

Table 1

| Logic state No. | Conditioning outputs | State-defining AND gate | Indication | | | |
|---|---|---|---|---|---|---|
| 1 | 00000 | 61 | "hour" | "minute" | "second" | |
| 2 | 10000 | 62 | "hour" | "minute" | "second" | "day of a week" |
| 3 | 11000 | 63 | "month" | "day of a month" | "year" | "day of a week" |
| 4 | 11100 | 64 | | "minute" | ("second") | |
| 5 | 11110 | 65 | | "minute" | ("second") | |
| 6 | 11111 | 66 | "hour" | | | |
| 7 | 01111 | 67 | | | | "day of a week" |
| 8 | 00111 | 68 | | "day of a month" | | |
| 9 | 00011 | 69 | "month" | | | |
| 10 | 00001 | not shown | | | "year" | |

It is presumed here that Nos. 1 through 3 logic states put the display control unit 40 in an indication or normal state and that the other logic states provide a "minute," an "hour," and a like state also listed in Table 1. The first three states are for the usual reading of the display or indication, while the remaining states are for correcting "minute," "hour," and similar indications, namely, "minutes," "hours," and others of the indication of time, respectively, in a manner described in the following. It will now be understood that the D-type flip-flops 46 through 50 and AND gates 61 through 69 are for the selection of the indication for reading and for correction and form display control means together with the display control unit 40. As will be understood by those skilled in the art, it is possible to design the display control unit 40 so as to make the display unit 10 give the indication to be corrected by a specific one of the blocks 11 and so on, and to give the indication and the dots 12 at a different frequency.

As shown in FIG. 2, an arrangement for correcting the indication of a timepiece of the type described, according to a first embodiment of this invention comprises first, second, third, fourth, and fifth control AND gates 71, 72, 73, 74, and 75 respectively connected to the outputs of flip-flop 51, OR gate 70, and AND gates 66, 67, and 68. The second through fith control AND gates 72 through 75 are normally disabled and are enabled only during "minute," "hour," "day of a week," and "day of a month" indication intervals, respectively, where the display unit 10 gives at least "minutes" of the indication, "hours" thereof, and so forth. When enabled, AND gates 72 through 75 allow a second switch signal K2 applied to their other input to pass therethrough. The first control AND gate 71 is disabled while the binary flip-flop 51 is normally in the first state. An AND gate 76 having inputs coupled to the $\overline{Q}$ terminal of flip-flop 51 and the output of AND gate 72 and accompanying the binary flip-flop input terminal CL is normally put in a first or enabled state by the first state signal $\overline{Q}$ to pass the second switch signal K2 which passed through the second control AND gate 72 enabled during the "minute" indication interval, to switch the binary flip-flop 51 into the second state. The second state signal Q switches the AND gate 76 into a second or disabled state, resets the first counter device 25, and enables the first control AND gate 71. The flip-flop group 31, however, is not reset but is kept in operation because the second switch signal K2 having passed through the second control AND gate 72 is supplied to the first AND gate 71 through an inverter. Closure of the second switch 42 during the "minute" indication interval thus puts the second pulse supply device 32 in its biased state where the 2 Hz output pulses are supplied to the second counter device 26 as the second input pulses in place of the first output signals. When the "minute" indication is thus advanced at a faster rate of 2 Hz to a certain indication of a correct time that will very shortly be or otherwise reported, the second switch 42 is released to put the second pulse supply device 32 back into its normal state. Inasmuch as no second switch signal K2 now passes through the second AND gate 72, a reset signal is supplied to the flip-flop group 31 through the first AND gate 71 already enabled by the second state signal Q. The flip-flop group 31, thus put out of operation, no longer produces the first input pulses for the first counter device 25 and the 2 Hz output pulses but the liquid crystal 32 Hz exciting signal as implied by a reset signal input terminal depicted between output terminals Q for the latter 32 Hz signal and the 2 Hz output pulses, although the 2 Hz output pulses may continuously be produced. As any time after the "minute" indication is corrected, the first switch 41 is released. Meanwhile, the first, second, and other counter devices 25 and so forth are kept still. Another AND gate 77 having inputs coupled to the output of OR gate 70 and the Q terminal of flip-flop 51 and accompanying the binary flip-flop input terminal CL is put normally in a first or disabled state and switched to a second or enabled state only during the "minute" indication interval and when the binary flip-flop 51 is put in the second state. When the first switch 41, preliminarily released after correction of the "minute" indication, is closed upon announcement of the correct time, a first switch signal K1 passes through the enabled AND gate 77 to switch the binary flip-flop 51 back to the first state. The flip-flop group 31 and the first counter device 25 are again put into operation to make the second and the following counter devices 26 and so on operate normally. Resetting of the flip-flop group 31 is desirable in order to raise the precision of correction.

It is to be understood that the adjusting AND gate 53 is disabled to prevent the logic "1" conditioning output signal Q3 of the third flip-flop 48 from conditioning the fourth flip-flop 49 when the binary flip-flop 51 is put into the second state in order to correct the "minute" indication. The first switch signal K1 that puts the binary flip-flop 51 back into the first state, therefore, puts the conditioning output signals from the No. 4 logic state into the No. 5 state rather than directly into the No. 6 state as described hereinabove. This makes it possible to again correct the "minute" indication if desired. For instance, repeated correction will be necessary when it is found that the indication is different from the correct time by a fraction of a "second." As the case may be, repeated correction is necessary when the first switch 41 is inadvertently put into the display position while the second switch 42 is held in the operative position to advance the second counter device 26 at the faster 2 Hz rate, although this may be avoided by a mechanical link (not shown) between the first and second switches 41 and 42. If unnecessary, the logic state may be advanced, with the second switch 42 left untouched, from No. 5 to No. 6 by again closing the first switch 41 after it is released. When the second switch 42 is never closed during the "minute" indication interval, the binary flip-flop 51 is kept in the first state without being switched to the second state so as to leave the AND gate 53 in the enabled state. A first switch signal K1 produced under the circumstances advances the logic state from No. 4 directly to No. 6. The AND gate 38 of the third pulse supply device 33 for the third counter device 27 is disabled during the faster advance of the second counter device 26 in order to prevent the third input pulses from being supplied to the third counter device 27 to advance the same. In any event, the third control AND gate 73 is enabled during the "hour" indication interval to allow a second switch signal K2, if produced, to pass therethrough. The second switch signal K2 having passed through the third AND gate 73 puts the third pulse supply device 33 into its biased state where another AND gate 79 supplies the 2 Hz output pulses to the third counter device 27 as the third input pulses to advance the same at the 2 Hz rate until the second switch 42 is released at an instant when the "hour" indication is corrected. In the meantime, the second switch signal K2 puts the fourth and fifth pulse supply devices 34 and 35 in a disabled state to suppress the application of the fourth and fifth input pulses to the fourth and fifth counter devices 28 and 29 respectively. In this manner, it is possible, if necessary, to successively correct the "days of a week," "days or a month," and other indications without regard to the announcement of the correct time. If desired, the third switch 43 may be put into the resetting or closed position either to put the logic state back to No. 1 from any other state or to keep the indication in the normal state. The third switch 43, if one is used, may be mechanically linked to a receptacle (not shown) for the battery 21 to dispense with the auto-clear circuit 56. The precision of correction achieved by an arrangement according to this invention for a timepiece having a liquid crystal display unit 10 is 1/32 "second."

Figure 3:
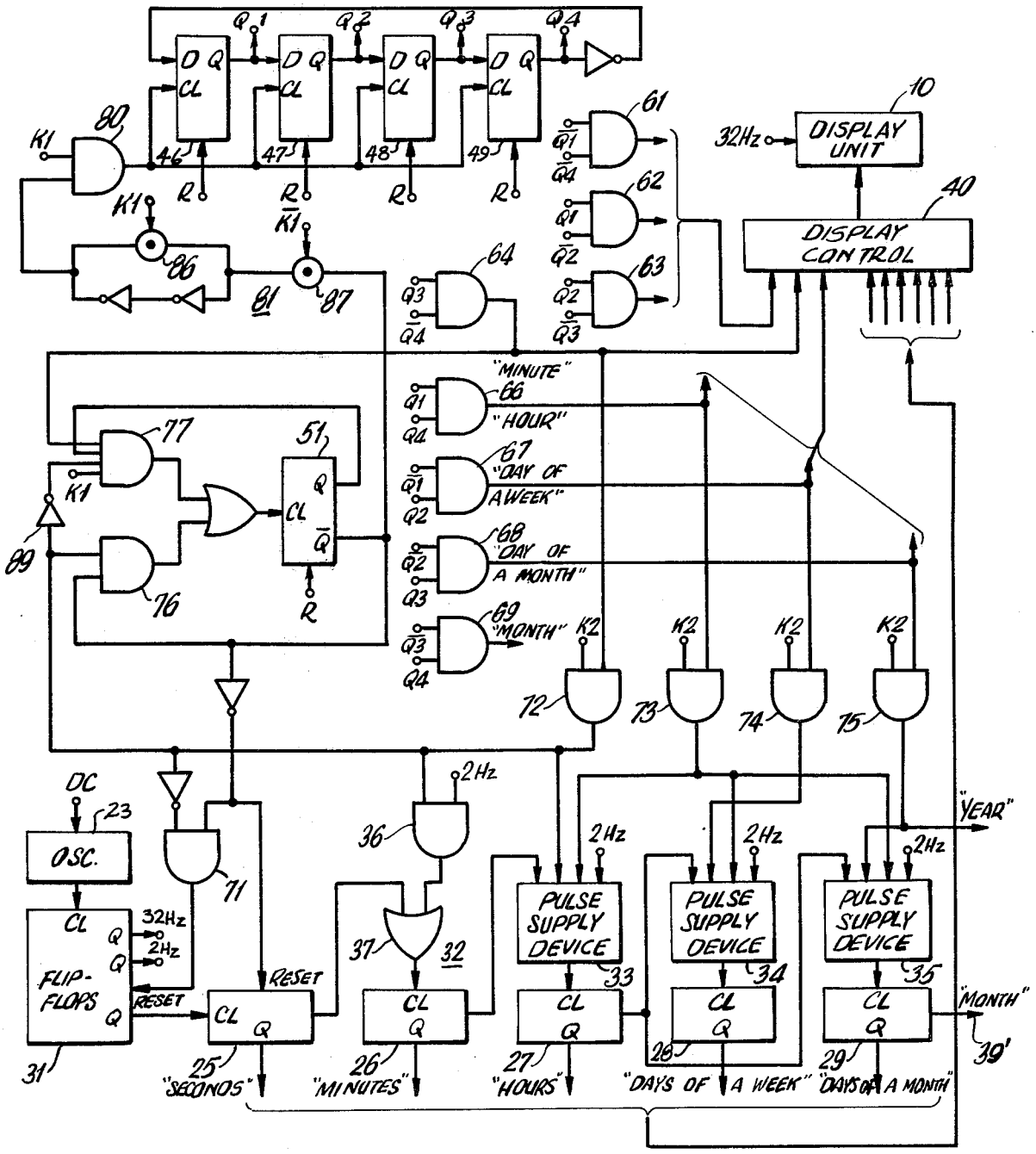
FIG. 3 is a partial block diagram of an arrangement according to a second embodiment of this invention and a part of an electronic timepiece comprising the arrangement.

An arrangement according to a second embodiment of this invention is shown in FIG. 3 for correcting the indication of a timepiece in a manner similar to that illustrated in FIG. 2.

Table 2

| Logic state No. | Conditioning outputs | State-defining AND gate | Indication | | | |
|---|---|---|---|---|---|---|
| 1 | 0000 | 61 | "hour" | "minute" | "second" | |
| 2 | 1000 | 62 | "hour" | "minute" | "day of a month" | "day of a week" |
| 3 | 1100 | 63 | | | | |
| 4 | 1110 | 64 | | "minute" | ("second") | |
| 5 | 1111 | 66 | "hour" | | | |
| 6 | 0111 | 67 | | | | "day of a week" |
| 7 | 0011 | 68 | | | "day of a month" | |
| 8 | 0001 | 69 | "month" | | | |

It will be understood that parts designated in FIG. 3 with like reference numerals as in FIG. 2 operate in a like manner. The embodiment of FIG. 3, however, does not use one of the state-defining AND gates 65 and the accompanying OR gate 70. As listed in Table 2, the logic states are for the conditioning output signals Q1, Q2, Q3, and Q4. In the example illustrated, the No. 3 logic state is either for no indication at all or for an indication of the dots 12 alone. This is to notify that the following indications are for correction. Instead of the adjusting AND gate 53 and additional D-type flip-flop 50 in the previously described embodiment of FIG. 2, the arrangement according to the second embodiment of FIG. 3 comprises an adjusting AND gate 80 between the first switch 41 (not shown in FIG. 3) and the cyclically connected flip-flops 46 through 49 and a latch circuit 81 between the adjusting AND gate 80 and the binary flip-flop 51. The latch circuit 81 comprises first and second transmission gates 86 and 87 connected as shown and supplied, respectively, with the first switch signal K1 and an inverted first switch signal $\overline{K1}$ that is rendered high when the first switch 41 is put in the rest position. Each of the transmission gates 86 and 87 is enabled and disabled when supplied with a high and a low signal. The latch circuit 81 thus holds the first state signal $\overline{Q}$ to enable the adjusting AND gate 80 every time when the first switch 41 is put into the display position from the rest position with the second switch 42 untouched. The latch circuit 81, however, holds the second state signal Q (a low $\overline{Q}$ output signal of the binary flip-flop 51) when the second switch 42 is closed during the "minute" indication interval. Under the circumstances, the latch circuit 81 disables the adjusting AND gate 80 when the first switch is subsequently closed. This keeps the display control unit 40 in the "minute" state so long as the second switch 42 is operated before the operation of the first switch 41. If desired, it is possible to advance the "minute" state to the "hour" state by putting the first switch 41 into the display position repeatedly twice without touching the second switch 42. Although not described in conjunction with the arrangement according to the first embodiment, the binary flip-flop 51 may be switched back to the first state without using the accompanying AND gate 77 but supplying the first switch signal K1 to the reset terminal of the flip-flop 51. Also, application to the accompanying AND gate 77 of the output signal of the state-defining AND gate 64 or gates 64 and 65 is not indispensable as symbolized in FIG. 3 by the broken lines. Instead, it is preferred in the embodiment of FIG. 3 that the second switch signal K2 having passed through the second control AND gate 72 be supplied to the accompanying AND gate 77 as one of two or three enabling signals therefor through an inverter 89. This prevents, with electronic circuitry, the binary flip-flop 51 from being erroneously switched back to the first state even when the first switch 41 is inadvertently put into the display position from the rest position during the fast advance of the second counter device 26.

What is claimed is:

1. An arrangement for correcting the indication of an electronic timepiece comprising:

a clock generator generating clock pulses;

first counter means for counting, when put into operation, first input pulses from zero to a predetermined integer in each "minute" to produce first output signals, said first counter means being put, when held in a reset state, in a state of counting zero;

first pulse supply means operatively coupled to said clock generator and responsive to said clock pulses for supplying said first input pulses to said first counter means;

second counter means for counting second input pulses to produce second output signals representative of "minutes" of the indication;

pulse producing means operatively coupled to said clock generator responsive to said clock pulses for producing output pulses of a period of about one "second";

second pulse supply means for supplying, when put in its normal state while said first counter means is kept in operation, said first output signals once in every "minute" to said second counter means as said second input pulses no second input pulses when put in a normal state while said first counter means is in a reset state, and no first output signals when put in a biased state;

third counter means for counting third input pulses to produce third output signals representative of the "hours" of the indication;

third pulse supply means for supplying to said third counter means as said third input pulses said second output signals once every "hour" when put in a normal state, said output pulses when put in a biased state, and none of said second output signals and said output pulses when put in a disabled state;

a display unit;

a first switch manually operable into a selected one of a display and a rest position; and display control means operatively coupled to said first switch, to said display unit, and to at least said second and third counter means and cyclically put in a plurality of states when said first switch is put into said display position, said plurality of states comprising a sequence of an indication state, a "minute" state, and an "hour" state, said display control means making said display unit display the indication when put in said "minute" state, and at least the "hours" of the indication when put in said "hour" state;

said arrangement comprising;

a second switch manually operable into a selected one of an operative and an inoperative position;

first control means operatively coupled to said first and second switches, said display control means, and said first counter means, said first control means normally being put in a first state for putting said first counter means into operation, switched to a second state when said second switch is put in said operative position while said display control means is kept in said "minute" state, and switched back to said first state when said first switch is put into said display position from said rest position while said first control means is put in said second state, said first control means holding said first counter means in said reset state when put in said second state;

second control means operatively coupled to said second switch, said display control means, and to said second and third pulse supply means for putting said second and third pulse supply means into a biased state and into a disabled state, respectively, when said second switch is put into said operative position while said display control means is kept in said "minute" state and for otherwise leaving said second pulse supply means in its normal state and said third pulse supply means in either of said normal and biased states; and adjusting means operatively coupled to said first switch, said display control means, and to said first control means for keeping said display control means in said "minute" state even when said first switch is put into said display position from said rest position at least once after said first control means is switched to said second state for the first time after said display control means in put into said "minute" state.

2. An arrangement as claimed in claim 1, wherein said first control means comprises:

a binary flip-flop responsive to a trigger signal for alternatingly producing a first and a second state signal;

means operatively coupled to said second switch, said display control means, and said flip-flop for producing said trigger signal when said second switch is put into said operative position while said display control means is put in said "minute" state and while said flip-flop produces said first state signal;

means operatively coupled to said first switch and said flip-flop for producing said trigger signal when said first switch is put into said display position from said rest position while said flip-flop produces said second state signal; and means operatively coupled to said flip-flop and said first counter means for holding said first counter means in said reset state only when said flip-flop produces said second state signal and for otherwise putting said first counter means in operation.

3. An arrangement as claimed in claim 2, wherein said second control means comprises:

an AND gate operatively coupled to said second switch and said display control means for permitting a second switch signal to pass therethrough when said second switch is put into said operative position while said display control means is in said "minute" state; and means operatively coupled to said AND gate and to said second pulse supply means for putting, only when said second switch signal is supplied thereto through said AND gate, said second pulse supply means in its biased state and for otherwise putting said second pulse supply means in its normal state.

4. An arrangement as claimed in claim 3, in which said first pulse supply means is capable of being put into operation and out of operation, said arrangement further comprising means operatively coupled to said AND gate, said binary flip-flop, and said first pulse supply means for making, unless said second switch signal is applied thereto through said AND gate, said second state signal put said first pulse supply means out of operation, and for otherwise putting said first pulse supply means in operation.

5. An arrangement as claimed in claim 1, wherein said adjusting means comprises gate means operatively coupled to said display control means and to said first control means for putting said display control means into said "hour" state from said "minute" state when said first switch is only once put into said display position from said rest position while said first control means is kept in said first state without being switched to said second state.

6. An arrangement as claimed in claim 5, in which said display control means produces a first conditioning output signal when it is put in said "minute" state and including means for putting said display control means into said "hour" state when said first switch is put into said display position from said rest position while said display control means is supplied with a conditioning input signal, wherein:

said adjusting means further comprises means operatively coupled to said first switch and said display control means for producing, while supplied with said first conditioning output signal, a second conditioning output signal when said first switch is put into said display position from said rest position;

said gate means comprising;

an AND gate enabled only when said first control means is kept in said first state and simultaneously when said flip-flop does not produce said second conditioning output signal to make said first conditioning output signal pass therethrough; and means for supplying either of said first and second conditioning output signals to said display control means as said conditioning input signal.

7. An arrangement as claimed in claim 1, wherein said adjusting means comprises gate means operatively interposed between said first switch and said display control means, said gate means being operatively coupled to said first switch, said first control means, and said display control means for coupling said first switch directly to said display control means unless said first control means is switched to said second state when said first switch is put into said display position from said rest position, and for keeping said display control means in said "minute" state unless said first switch is once again put into said display position from said rest position after said first control means is switched back to said first state from said second state without being further switched to said second state.

8. An arrangement as claimed in claim 7, wherein:

said adjusting means further comprises a latch circuit operatively coupled to said first switch and said first control means for holding one of said first and second states until said first switch is put into said rest position for the first time after said first control means is switched to said one state;

said gate means comprising an AND gate enabled only when said latch circuit holds said first state, the enabled AND gate supplying said first switch signal to said display control means to change its state.

9. An arrangement as claimed in claim 7, wherein said first control means comprises:

a binary flip-flop responsive to a trigger signal for alternatingly producing a first and a second state signal;

means for making said flip-flop normally produce said first state signal;

means operatively coupled to said second switch, said display control means, and said flip-flop for producing said trigger signal when said second switch is put into said operative position while said display control means is put in said "minute" state and while said flip-flop produces said first signal;

means operatively coupled to said first and second switches and said flip-flop for producing said trigger signal when said first switch is put into said display position from said rest position while said flip-flop produces said second state signal and after said second switch is put back to said inoperative position; and means operatively interposed between said flip-flop and said first counter means for holding said first counter means in said reset state only when said flip-flop produces said second state signal and for otherwise putting said first counter means in operation.

10. An arrangement as claimed in claim 1, further comprising third control means operatively coupled to said second switch, said display control means, and said third pulse supply means for putting said third pulse supply means into its biased state when said second switch is put in said operative position while said display control means is kept in said "hour" state and for otherwise leaving said third pulse supply means in either of its normal and disabled states.

11. An arrangement as claimed in claim 10, in which said timepiece further comprises:

fourth counter means for counting fourth input pulses to produce fourth output signals representative of a selected one of "day of a week" and "days of a month"; and fourth pulse supply means for supplying to said fourth counter means as said fourth input pulses the third output signals once every day, when put in a normal state, said output pulses when put in a biased state, and one of said third output signals and output pulses when put in a disabled state;

said display control means being operatively coupled to said fourth counter menas, said display control means being put, while being cylically put in said plurality of states, in a "day of a week" or a "day of a month" state following said "hour" state as said fourth output signals represent "days of a week" or "days of a month," respectively, said display control means making said display unit further display at least "days of a week" and at least "days of a month" when put in said "day of a week" and "day of a month" states, respectively; wherein:

said third control means comprises means operatively coupled to said second switch, said display control means, and said fourth pulse supply means for putting, when said second switch is put in said operative position while said display control means is kept in said "hour" state, said fourth pulse supply means in its disabled state and for otherwise leaving said fourth pulse supply means in either of its normal and biased states;

said arrangement further comprising additional control means operatively coupled to said second switch, said display control means, and said fourth pulse supply means for putting said fourth pulse supply means in its biased state when said second switch is put in said operative position while said display control means is kept in a pertinent one of said "day of a week" and "day of a month" states, and for otherwise leaving said fourth pulse supply means in its normal state.

12. An arrangement as claimed in claim 11, further comprising:

a third switch manually operable into a sequential and a resetting position; and means operatively coupled to said third switch and said display control means for allowing said first switch to cyclically put said display control means in said plurality of states when said third switch is put in said sequential position and for putting, when said third switch is put into said resetting position, said display control means back to said indication state from one of said plurality of states in which said display control means is put.

* * * * *